United States Patent [19]

Edwards et al.

[11] 3,952,450

[45] Apr. 27, 1976

[54] PROTRUDING LADDER STEPS FOR MODEL RAILWAY BOXCARS

[76] Inventors: Clarence K. Edwards, 865 Morrison St.; Lawrence D. Edwards, 2816 Rosemont Ave., both of Medford, Oreg.

[22] Filed: Feb. 16, 1972

[21] Appl. No.: 226,701

[52] U.S. Cl. ..... 46/218
[51] Int. Cl.[2] ..... A63H 19/16
[58] Field of Search ..... 46/218, 16, 17, 216, 46/217, 221

[56] References Cited

UNITED STATES PATENTS

| | | | |
|---|---|---|---|
| 403,165 | 5/1889 | Wilkins | 46/218 |
| 1,186,994 | 6/1916 | Kramer | 46/218 |
| 1,849,877 | 3/1932 | Lyons et al. | 46/218 |
| 2,610,442 | 9/1952 | Bonnano | 46/218 |
| 3,546,810 | 12/1970 | Ernst | 46/218 |

*Primary Examiner*—F. Barry Shay
*Attorney, Agent, or Firm*—Clarence M. Crews

[57] ABSTRACT

In the manufacture of model railway boxcars, simulated mounting steps which protrude downward beyond the car body have heretofore been normally composed of the same brittle material as the car body, and have been made integral with the car body, but according to the present invention they are made as parts of highly flexible and resilient, discrete units which are adapted to be fixedly associated with the car floor and body.

4 Claims, 5 Drawing Figures

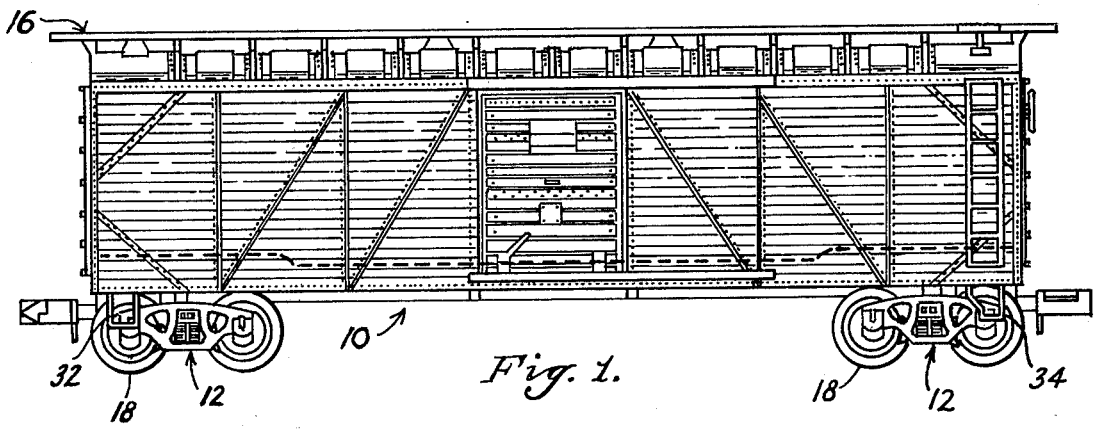
Fig. 1.
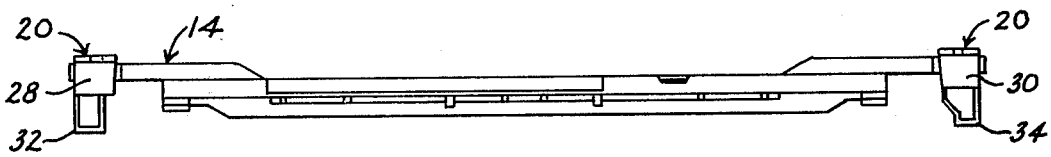
Fig. 2.
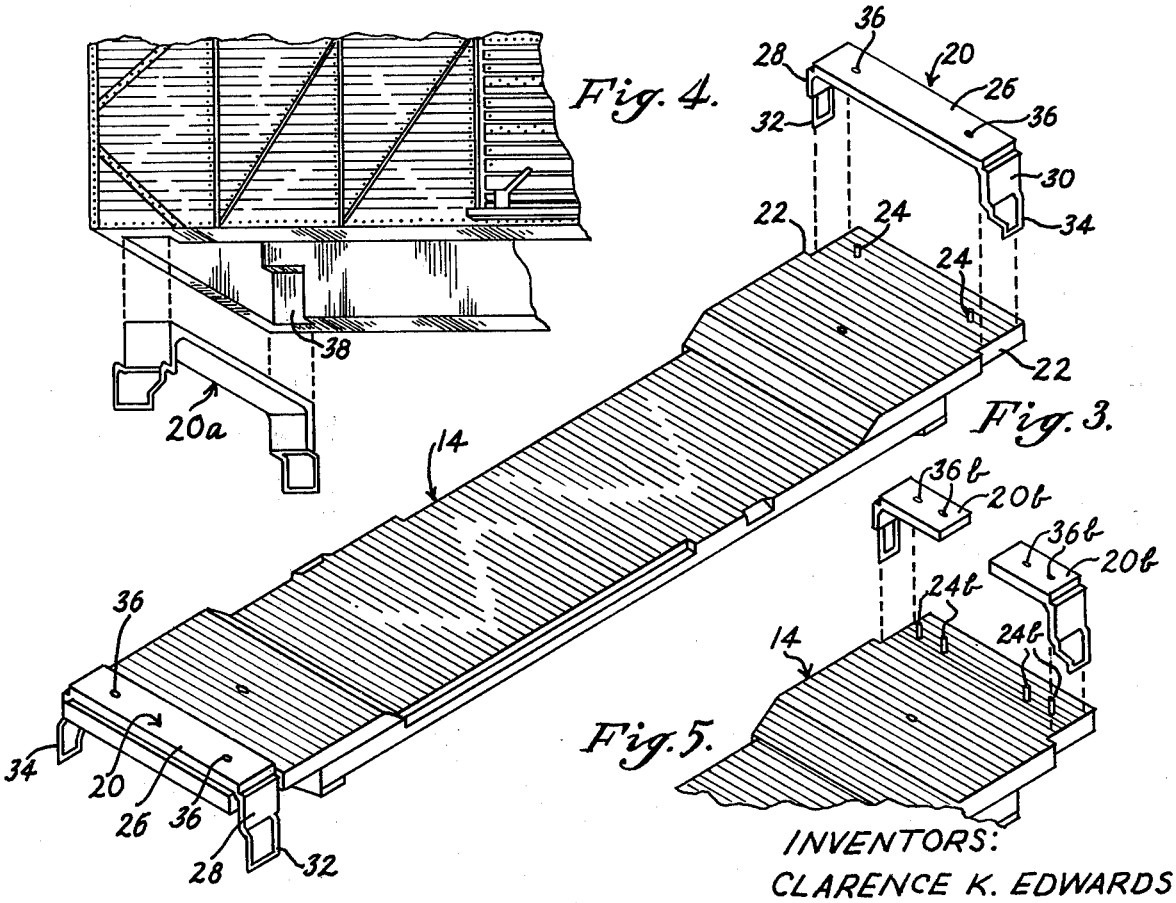
Fig. 4.
Fig. 3.
Fig. 5.
INVENTORS:
CLARENCE K. EDWARDS
and LAWRENCE D. EDWARDS
by: Clarence M. Crews
THEIR ATTORNEY

PROTRUDING LADDER STEPS FOR MODEL RAILWAY BOXCARS

Model railway boxcar bodies are generally molded as body units composed of rather brittle, plastic material. The use of this material is practically advantageous so far as the car body walls (roof, sides and ends) are concerned, because these parts are generally solid and continuous, and for the further important reason that these parts may be made disproportionately thick without detriment to the apparent fidelity of structural resemblance to genuine, standard gauge railroad equipment.

As a rule, however, model railway car bodies are made with integral simulated ladders at one end of each side and at one side of each end, in association therewith, and protruding single step members are integrally provided at the ends of both sides. The independent single step members and the bottom steps of the side ladders protrude downward beyond the lower boundary of the body proper. Even though objectionably exaggerated in thickness, as compared with true scale, each such step member is extremely vulnerable to breakage 1. as the body, in the course of manufacture, is discharged from the body-forming mold;

2. in the course of painting, lettering and numbering, for finishing;

3. in the course of assembly and/or packing for shipment of the car or car parts; and 4. in the course of handling and operation by the purchaser who is the ultimate user.

When breakage occurs as an incident of discharge of the car body from the car body mold, the entire car body must be discarded as unsaleable. This, however, is the most tolerable stage at which breakage may occur, because no further labor and materials are expended upon the discarded car body.

If breakage occurs during assembly or packing, it is a painted, decorated, lettered and numbered car body that must be discarded, possibly the body of a fully assembled car. In the latter case, parts, such as the floor, trucks and couplers, must then be salvaged and assembled with another car body.

Whether or not the car is pre-assembled by the manufacturer, if a protruding step is damaged during or after shipment, it is the purchaser (ultimate user) who must acquire a new car body, and assemble the new car body with the undamaged parts.

All manufacturing operations are slowed down because of the care with which the car bodies must be handled in order to avoid the breaking off of one or more of the fragile protruding steps. At every step of manufacture and packing, the condition of the protruding steps must be noted and taken into account in order to forestall wasted effort with regard to a car body which has become unsaleable.

In the hands of the ultimate user and his friends, the cars may be derailed, knocked off a table, or handled roughly, generally in ignorance of the fragility of the protruding steps. Elimination of this weakness is greatly to be desired from the standpoints of economy of manufacture, customer satisfaction and practical soundness of the product.

It is the primary object of this invention to eliminate the drawbacks referred to by a. making the protruding steps as separate parts, distinct from the car body and floor units;

b. contriving an arrangement whereby the protruding steps may be conveniently, dependably and inexpensively associated with the car floor and car body; and c. making the protruding step units of an extremely resilient plastic material which has no tendency to snap in two when subjected to sharp blows or other deforming influences.

In consequence of these improvements, a. the former fragility of the bottom ladder steps is overcome;

b. the thickness of the lower ladder step may be reduced as compared with current conventional practice, thus producing a more realistic appearance;

c. no car body needs ever to be discarded because of ladder step breakage; and d. if a protruding step is damaged either in the course of manufacture or in the hands of the ultimate user, it can be inexpensively replaced by the mere substitution of an inexpensive ladder step unit.

Other objects and advantages will hereinafter appear.

In the drawing forming part of this specification,

FIG. 1 is a view in side elevation of a fully assembled model railroad boxcar;

FIG. 2 is a view in side elevation of a model railroad boxcar floor to which protruding ladder step units have been applied at both ends;

FIG. 3 is a partially exploded, perspective view of the floor with a protruding step unit applied at one end and a second protruding step unit in position to be applied at the other end;

FIG. 4 is a fragmentary, perspective, exploded view as seen from below of one end of a car and an associated protruding step unit; and FIG. 5 is a fragmentary view, similar to FIG. 3, in which two distinct protruding step units are provided at a car end.

The car 10 comprises trucks 12, a floor 14, and a body 16. As shown, the trucks 12 and associated wheels 18 are of conventional construction. The floor 14 and body 16 are also of conventional construction except to the extent that they have been modified for the purpose of eliminating the protruding ladder steps from the body, and accommodating the association of separately provided protruding step units with the floor and body.

Identical step units in the form of U-shaped saddles 20 are provided for application to opposite ends of the floor 14. For the purpose of accommodating units of this kind the floor 14 is modified at both ends, being notched at opposite sides as indicated at 22, and being formed with a plurality of upstanding jig posts or projections 24.

Each protruding step unit 20 is a molded unit composed of a very resilient plastic material, desirably a Du Pont product known commercially as "Delrin." Each unit 20 comprises a cross-member 26, downturned solid members 28 and 30, and terminal protruding step members 32 and 34. Each cross-member 26 is provided with a plurality of perforations 36 which fit onto jig posts 24 of the car floor.

When both members 28 have been fitted into place as indicated at the left hand end of FIG. 3, the lower margin of the car body is snapped into place over the floor 14, and the car assembly is completed in the conventional manner, by the addition of trucks, wheels and couplers.

In FIG. 4 a modified embodiment of the invention is shown. A protruding step unit 20*a* is provided as in FIG. 3, without jig posts and corresponding holes, and the car body is formed interiorly with notches 38 for receiving the ends of the protruding step unit 20*a*, so that the unit 20*a* may be first associated with the car body and will hold its assigned position relative to the car body during assembly.

In FIG. 5 the protruding steps at opposite sides of the car form parts of separate units 20*b*, each of which includes a plurality of perforations 36*b* which fit onto jig posts 24*b* provided on the car floor.

We have described what we believe to be the best embodiment of our invention. What we desire to protect by letters patent is set forth in the following claims.

We claim:

1. A model railway boxcar comprising, in combination, a. a rigid car floor unit b. a substantially rigid, unitary car body unit, and c. a protruding-step-simulating unit distinct from the floor and body units, composed of more highly flexible and resilient, moldable material than the floor and body units, said protruding-step-simulating unit constructed and arranged to have fixed interfitting relation with at least one of said other units and to be retained in place by them, said protruding-step-simulating unit comprising a cross-member engageable with the upper surface of a floor end, at least one downwardly extending side member, and at least one terminal step member integral with such side member, and constructed and arranged to extend below and beyond the lower boundary of the car body.

2. A model railway boxcar as set forth in claim 1 in which the floor member is notched for reception of the down-turned ends of the protruding-step-simulating unit, and in which the cross-member of said unit and the car floor are formed with correspondingly located interfitting parts for assuring the retention of said unit in fixed relation to said floor.

3. A model railway boxcar comprising, in combination, a. a rigid car floor unit, b. a substantially rigid, unitary car body unit, and c. a protruding-step-simulating unit distinct from the floor and body units, composed of more highly flexible and resilient, moldable material than the floor and body units, said protruding-step-simulating unit constructed and arranged to have fixed interfitting relation with at least one of said other units, to be retained in place by them, to extend completely across the floor and to include simulated protruding steps at both of its opposite ends.

4. A model railway boxcar as set forth in claim 3 in which the body is notched to receive opposite ends of the protruding-step-simulating unit, whereby the protruding-step-simulating unit may be first fitted into the car body, before the car body unit and the floor unit have been brought together.

* * * * *